United States Patent [19]

Sidorenko et al.

[11] 3,972,204

[45] Aug. 3, 1976

[54] REFRIGERATOR

[76] Inventors: Mikhail Kirillovich Sidorenko, pereulok Vodometny, 9, kv. 7; Jury Ivanovich Cherkashin, ulitsa Chaikovskogo, 11, kv. 30; Nikolai Nikolaevich Lopatin, pereulok Rechnoi, 3, kv. 95, all of Krasnoyarsk, U.S.S.R.

[22] Filed: Jan. 24, 1975

[21] Appl. No.: 543,904

[52] U.S. Cl. ..... 62/447; 62/517; 62/523

[51] Int. Cl.[2] ..... F25D 11/02; F25B 39/02

[58] Field of Search ..... 62/516, 517, 523, 446, 62/447, 404, 407

[56] References Cited

UNITED STATES PATENTS

| | | | |
|---|---|---|---|
| 1,324,868 | 12/1919 | Wolf | 62/517 |
| 1,979,142 | 10/1934 | Cowan | 62/517 |
| 2,613,509 | 10/1952 | Philipp | 62/447 |
| 2,737,783 | 3/1956 | Mann | 62/517 |
| 3,134,242 | 5/1964 | Hanson | 62/523 |
| 3,188,831 | 6/1965 | Hellstrom | 62/447 |

*Primary Examiner*—Lloyd L. King
*Attorney, Agent, or Firm*—Haseltine, Lake & Waters

[57] ABSTRACT

The proposed refrigerator comprises a housing with a cooling chamber and a freezing chamber disposed inside said housing. The freezing chamber comprises an evaporator constructed as a four-wall shell with a heat-insulating layer on the internal surface of the side walls of the shell and the outer surfaces of its two other walls, each wall of the shell having a slot to receive the heat-insulating layer as it extends from one wall to another.

5 Claims, 6 Drawing Figures

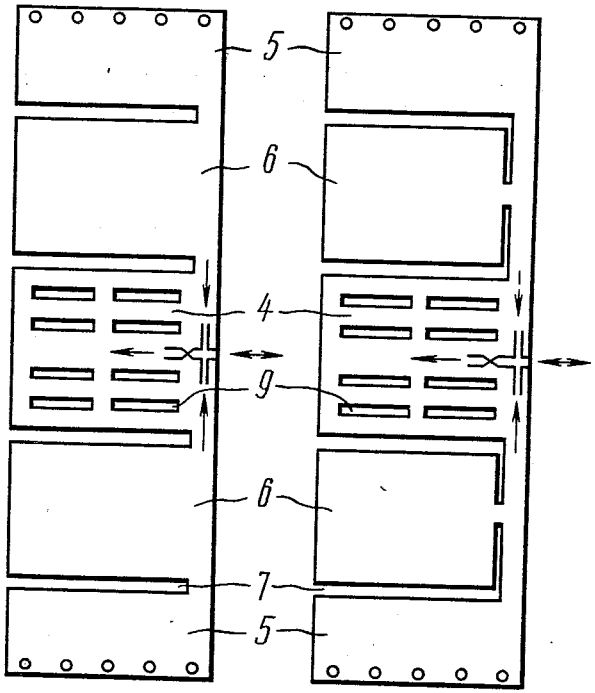
FIG. 5
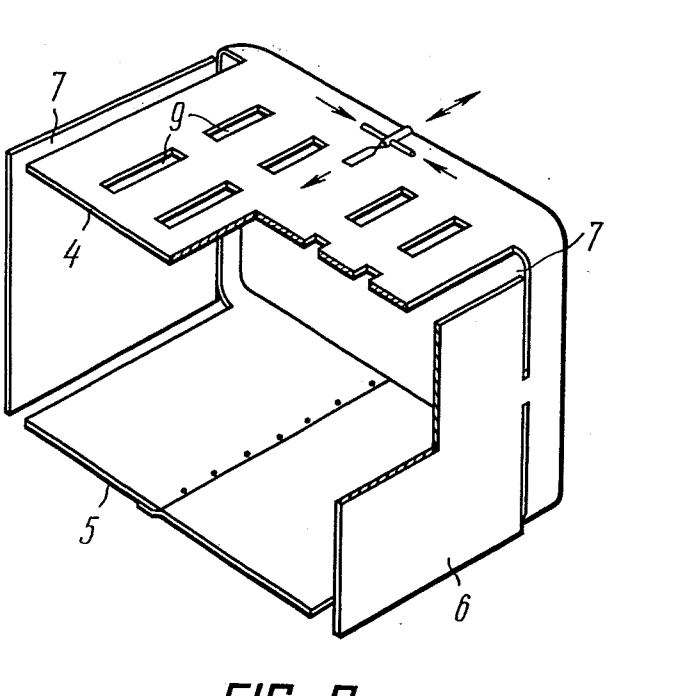
FIG. 4
FIG. 3

REFRIGERATOR

The present invention relates to refrigerators, in particular, to refrigerators for storing foodstuffs and drugs.

There is known a refrigerator comprising a housing with a cooling chamber inside said housing. At the upper portion of the cooling chamber there is a freezing chamber which is an evaporator coated with a heat-insulating layer. The evaporator is constructed as a four-wall shell of a substantially rectangular shape, having an upper wall, a lower wall and two side walls. Inside each wall there are ducts for the circulation of a cooling agent.

The longitudinal axis of the freezing chamber is displaced with respect to that of the cooling chamber and is closer to one of the side walls of the refrigerator's housing.

The evaporator of the freezing chamber communicates with that of the cooling chamber by means of a partition having ducts for the circulation of the cooling agent. The evaporator of the cooling chamber is arranged close to the second side wall of the refrigerator's housing.

The evaporator of the cooling chamber is constructed in the form of a panel having ducts therein for the circulation of the cooling agent and is intended to cool the cooling chamber and maintain a desired temperature therein.

The air in the freezing chamber is cooled by means of the four walls of the shell. The air in the cooling chamber is cooled on one side of the cooling chamber, by means of the evaporator constructed in the form of a panel. This produces only one air flow in the cooling chamber in the course of free air circulation. The air flow is displaced to one side of the cooling chamber, which accounts for an uneven distribution of cooled air in that chamber, as well as for different temperatures at different parts of the cooling chamber.

This also causes the formation of stagnant air zones under the freezing chamber, close to the wall which is opposite the evaporator panel, which stagnant zones have a higher temperature than the rest of the cooling chamber. This accounts for a rapid spoilage of foodstuffs in said stagnant zones in that part of the cooling chamber which is opposite the evaporator.

It is an object of the present invention to provide a refrigerator which ensures an even temperature distribution throughout the volume of the cooling chamber.

It is another object of the present invention to provide a refrigerator which is cheaper than the conventional ones.

The foregoing and other objects of the invention are attained by provising a refrigerator comprising a housing with a cooling chamber disposed inside said housing and a freezing chamber arranged at the upper portion of said cooling chamber, said freezing chamber comprising an evaporator with a heat-insulating layer, said evaporator being constructed as a four-wall shell, wherein the heat-insulating layer is arranged, according to the invention, on the internal surfaces of the side walls of said shell and on the external surfaces of its two other walls, the upper and the lower, each wall having a slot at the place where it adjoins another wall, which slot is meant to receive the heat-insulating layer as it extends from one wall to another.

According to the invention, each slot is open on one side of the wall.

According to one embodiment of the invention, there is one slot on the opposite sides of the side walls of the shell which slots are L-shaped, the shorter portions of the slots being directed towards each other. The portions of the side walls beyond the slots are installed in the heat-insulating layer.

In the proposed refrigerator there is a gap between the side walls of the shell, which have a heat-insulating layer on their internal surfaces, and the side walls of the housing.

In accordance with the invention, the top wall of the shell is provided with holes and is spaced at some distance from the heat-insulating layer disposed along its external surface.

The arrangement of the heat-insulating layer on the internal surfaces of the side walls of the shell and the external surfaces of the upper and lower walls of the shell accounts for the fact that the freezing chamber is freezed only by two walls of the shell, the upper and the lower, whereas the cooling chamber is cooled by the two side walls of the shell, which walls are outside the heat-insulating layer.

The presence of the heat-insulating layer on the internal surfaces of the side walls of the shell rules out the ingress of heat fluxes into the freezing chamber in the course of defrosting these walls, which helps to produce and maintain a desired temperature in the freezing chamber.

The arrangement of the cooling surfaces of the side walls of the shell on two sides of the cooling chamber and at some distance from the side walls of the housing produces in the cooling chamber, in the course of free air circulation therein, two identical air flows which provide for a more even distribution of cooled air throughout the volume of the cooling chamber and for equal temperatures at different points of the cooling chamber.

The provision of slots in each walls of the shell, substantially at the joints of these walls, which slots are open on one side, makes it possible to install the heat-insulating layer in said slots, which heat-insulating layer is arranged on the external surface of the side walls and the internal surface of the top and bottom walls of the shell.

The provision of the slots in the side walls of the shell, there being one such slot at each opposite end of said walls, the shorter portions of said slots being directed towards each other, accounts for reduced heat fluxes from the side walls to the top and bottom walls of the shell in the course of defrosting the side walls.

The arrangement of the portions of the side walls, which are beyond the slots, inside the heat-insulating layer rules out the formation of ice crust one said portions. As a result, it is unnecessary to defrost said portions, which otherwise might raise the temperature at the top and bottom walls of the shell.

The provision of holes in the top wall of the shell and the arrangement of this wall at some distance from the heat-insulating layer on the outside of said wall accounts for an increased actual cooling surface of the freezing chamber.

The cooling of the air in the cooling chamber by the external surface of the side walls of the shell makes it possible to dispense with the evaporator constructed as a panel, which evaporator is a part of conventional refrigerators; this makes the proposed refrigerator cheaper than the conventional ones.

Other objects and advantages of the present invention will become more apparent from the following detailed description of a preferred embodiment thereof taken in cojunction with the accompanying drawings, wherein:

FIG. 3 is a general, partially cut-away view of a shell in accordance with the invention;

FIG. 4 is a developed view of a shell with rectangular slots in accordance with the invention;

FIG. 5 is a developed view of a shell with L-shaped slots in accordance with the invention;

Figure 1:
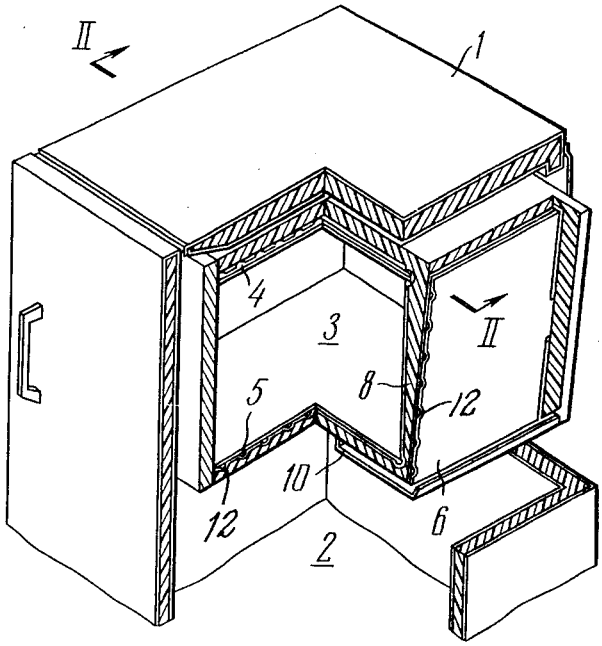
FIG. 1 is a perspective, partially cut-away view of a refrigerator in accordance with the invention.

Referring now to the attached drawings, the proposed refrigerator comprises a housing 1 (FIGS. 1 and 2) with a cooling chamber 2 arranged in said housing 1 and a freezing chamber 3 arranged at the upper portion of the cooling chamber 2.

The freezing chamber 3 is formed by an evaporator constructed as a four-wall shell of a substantially rectangular shape, having a top wall 4, a bottom wall 5 and two side walls 6.

In each adjoining wall of the shell, substantially at the joints of these walls, there is a slot 7 (FIGS. 3 and 4). Each slot 7 receives a heat-insulating layer 8 (FIG. 2), which layer is arranged on the internal surface of the side walls 6 and on the external surface of the top wall 4 and the bottom wall 5 of the shell. The heat-insulating material is foamed polyurethane.

At one end of each wall 4, 5 and 6 the slots 7 are open to receive the heat-insulating layer 8 as it extends from one wall to another.

Holes 9 are provided in the top wall 4 of the shell. Said wall 4 is arranged at some distance from the heat-insulating layer 8 disposed along its external surface.

The provision of the holes 9 in the top wall 4 of the shell and the arrangement of said wall 4 at some distance from the heat-insulating layer 8 accounts for an increased actual cooling surface of the freezing chamber 3.

The side walls 6 (FIG. 2) of the shell are spaced at some distance from the side walls of the housing 1.

The external surfaces of the side walls 6 cool the cooling chamber 2, whereas their internal surfaces, which abut against the heat-insulating layer 8, rule out the ingress of heat into the freezing chamber 3 along the side walls 6 in the course of operation of the refrigerator.

The arrangement of the side walls 6 of the shell at some distance from the side walls of the housing 1 and the cooling of the cooling chamber 2 by the two external surfaces of said walls 6 ensures the formation, in the course of free air circulation, of two identical air flows in the cooling chamber 2, which air flows account for even distribution of cooled air and equal temperatures at any point in the chamber.

The arrangement of the heat-insulating layer 8 on the internal surfaces of the side walls 6 rules out the ingress of heat into the freezing chamber 3 and a change in its temperature in the course of defrosting the side walls 6 of the shell.

Said slots 7 (FIG. 5) may be provided only in the side walls 6 of the shell. This being the case, there is one slot 7 on the opposite sides of each side wall 6, said slots 7 being L-shaped, their shorter portions being directed towards each other.

Figure 2:
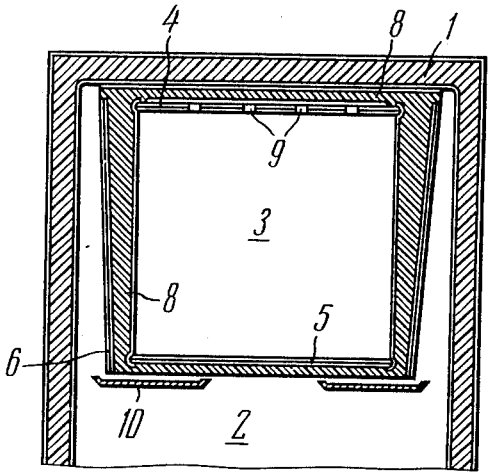
FIG. 2 is a section taken along the line II — II of FIG. 1.
Figure 6:
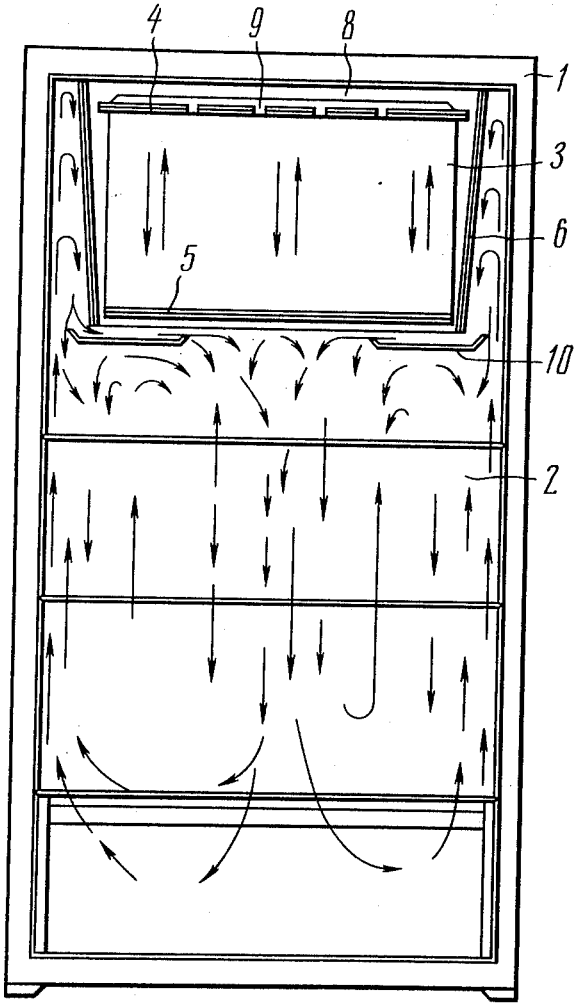
FIG. 6 is a diagram of the air flow distribution in the refrigerator.

The portions of the side walls 6, which are beyond the slots 7, are installed in the heat-insulating layer 8 (FIG. 1).

The foregoing arrangement and shape of the slots 7 hinders the ingress of heat from the side walls 6 of the shell to its top wall 4 and bottom wall 5 in the course of defrosting the side walls 6.

The arrangement of the portions of the side walls 6, which portions are beyond the slots 7, in the heat-insulating layer 8 rules out the formation of ice crust on these portions and makes it unnecessary to defrost these portions, which otherwise might raise the temperature at the top wall 4 and the bottom wall 5 of the shell.

Arranged on the external surface of the side walls 6 are heating elements (not shown) for automatic defrosting.

Arranged under the side walls 6 in the cooling chamber 2 are trays 10 (FIG. 2) to collect water produced in the course of defrosting the cooling chamber. The water accumulated in the trays 10 is removed from the refrigerator.

The proposed refrigerator operates as follows.

A liquid cooling agent, which is Freon-12, is introduced into the ducts 12 of the shell, where it boils intensively, taking heat away from its walls and bringing their temperature down to between minus 28° and minus 36°C.

The cooling of the walls 4, 5 and 6 of the shell produces free air circulation in the freezing chamber 3 and the cooling chamber 2.

As this takes place, warm air moves upwards and is cooled, whereby a certain mean temperature is produced in the freezing chamber 3 and the cooling chamber 2.

The fact that the cooling chamber is cooled by the two external surfaces of the side walls 6 of the shell, which walls are spaced at a distance from the side walls of the housing 1, accounts for even distribution of cooled air throughout the volume of the cooling chamber 2. The arrangement under the freezing chamber 3 of the trays 10 to accumulate water makes it possible to direct part of cooled air to the central portion of the cooling chamber 2, which rules out the formation of a stagnant air zone under the freezing chamber 3.

The refrigerator of the present invention ensures a temperature in the cooling chamber not higher than plus 5°C, whereas in the freezing chamber there is automatically maintained a temperature not higher than minus 18°C.

From the ducts of the shell the vapours of Freon-12 are removed through a suction flue (not shown) to the jacket of a compressor (not shown) and are then directed to a condenser (not shown), where they are condensed and directed through a capillary tube (not shown) back to the shell. The sequence of events is then repeated.

The refrigerator of the present invention ensures an even distribution of cooled air in the cooling chamber 2 and a uniform temperature at different points thereof, which, in turn, ensures long-term refrigerated storage of foodstuffs and drugs.

In addition, the proposed refrigerator is cheaper than the conventional types of refrigerators.

What is claimed is:

1. A refrigerator comprising: a housing; a cooling chamber inside said housing; a freezing chamber arranged at the upper portion of said cooling chamber and constructed as an evaporator with a heat-insulating layer; said evaporator being constructed as a four-wall shell of a substantially rectangular shape, comprising a top, bottom and two side walls; each of said walls having a slot substantially at the place where it is joined with an adjoining wall; said heat-insulating layer being arranged on the internal surfaces of said side walls of said shell and on the external surfaces of said top and bottom walls of said shell and passing through each of said slots as it extends from one wall to another.

2. A refrigerator as claimed in claim 1, wherein each slot at one end of a wall is open.

3. A refrigerator as claimed in claim 1, wherein said side walls of the shell have one slot at the opposite ends thereof, the slots being L-shaped, their shorter portions being directed toward each other, whereas the portions of the side walls that are beyond the slots are arranged in the heat-insulating layer.

4. A refrigerator as claimed in claim 1, wherein there is a gap between the side walls of the shell, on whose internal surfaces the heat-insulating layer is arranged, and the side walls of the housing.

5. A refrigerator as claimed in claim 1, wherein holes are provided in the top wall of the shell, said wall being spaced at some distance from the heat-insulating layer extending along its external surface.

* * * * *